United States Patent [19]

Sperber

[11] Patent Number: 4,768,710

[45] Date of Patent: Sep. 6, 1988

[54] FIBROUS BLOWN-IN INSULATION HAVING HOMOGENOUS DENSITY

[76] Inventor: Henry Sperber, 8 Red Fox La., Englewood, Colo. 80111

[21] Appl. No.: 20,693

[22] Filed: Sep. 6, 1988

[51] Int. Cl.[4] ..... B01F 5/08; B05B 7/00

[52] U.S. Cl. ..... 239/8; 239/427.5; 52/743; 428/71

[58] Field of Search ..... 239/8, 419.3, 427.5, 239/428, 432, 433; 366/101, 336; 428/71, 74, 75, 76; 52/404, 743

[56] References Cited

U.S. PATENT DOCUMENTS

| | | | |
|---|---|---|---|
| 3,199,790 | 8/1965 | Geisemann | 239/428 |
| 3,667,732 | 6/1972 | Lejeune | 366/173 |
| 4,050,677 | 9/1977 | Benthin | 366/101 |
| 4,103,876 | 8/1978 | Hasselman, Jr. et al. . | |
| 4,135,882 | 1/1979 | Harkness et al. . | |
| 4,213,936 | 7/1980 | Lodrick | 239/427.5 |
| 4,303,450 | 12/1981 | Hacker | 106/98 |
| 4,402,892 | 9/1983 | Helser . | |
| 4,411,389 | 10/1983 | Harrison | 239/428 |
| 4,447,560 | 5/1984 | Piersol . | |
| 4,487,365 | 12/1984 | Sperber . | |
| 4,530,468 | 7/1985 | Sperber . | |

*Primary Examiner*—Andres Kashnikow
*Assistant Examiner*—Chris Trainor
*Attorney, Agent, or Firm*—Sheridan, Ross & McIntosh

[57] ABSTRACT

A blown-in fibrous insulation is provided in a substantially homogenous-density form. A foamed material in its foamed state is mixed with already-lofted fibrous particles and the mixture is blown into a desired space. The foam acts to maintain the fibrous particle loft during impaction from subsequent applications of the insulation material or from the weight of insulation material above. The foam preferably contains an adhesive material which sets or cures to maintain the fiber loft by the time the foam material dries and dissipates. A nozzle designed to provide the described mixing of materials and to avoid backflow and consequent clogging or plugging is provided.

10 Claims, 1 Drawing Sheet

FIBROUS BLOWN-IN INSULATION HAVING HOMOGENOUS DENSITY

FIELD OF THE INVENTION

The present invention is related to fibrous insulation material and a method and apparatus for producing such material and in particular to fibrous insulation which can be blown into a desired space so as to assume and maintain substantially homogeneous density.

BACKGROUND INFORMATION

Methods for supplying fibrous insulating materials by injection under air pressure provide a generally economical method of insulating a desired space. Such methods are economical at least partly because relatively inexpensive fibrous materials such as cellulose, or mineral fibers, fiberglass and the like can be used, as described, for example, in U.S. Pat. No. 4,487,365 issued Dec. 11, 1984, to Sperber and U.S. Pat. No. 4,530,468 issued July 23, 1985, to Sperber, and also because of the relative speed with which the insulation can be blown in compared with the installation of batt-type insulation.

The process of blowing-in fibrous insulation, however, typically produces insulation with nonhomogeneous density. This is partly because the first portions of blown-in insulation are compacted when they are impacted by later portions of blown-in insulation. Insulation in the lower regions of a vertical column of insulation are compacted by the weight of the insulation above. Furthermore, there is a settling of the fibers over time reducing the homogeneity of the insulation product. Although an adhesive can be used to assist in maintaining the loft of fibrous insulation, as described in the Sperber patents above, the adhesive may have insufficient time to set, cure or dry before impaction from succeeding portions of insulation occurs and may have insufficient strength to withstand the force of impact from succeeding portions of blown-in insulation. Additionally, the adhesive by itself may not be sufficiently spread or mixed with the fibers to provide the desired separation of the fibers.

In general, compacted or densified fibrous insulation has a lower insulating capacity compared to less dense or un-compacted fibrous insulation. Thus, if, for example, a vertical wall is to be insulated at a given R-value, the upper, typically non-compacted region must be insulated at a greater-than-desired R-value in order to assure that the lower, typically compacted regions attain at least the desired R-value. In this way, compaction commonly accompanying blown-in insulation increases insulation costs.

As opposed to fibrous insulation, insulation comprising a solid "foam" is used in some applications. Although fibrous material can be incorporated into such foam as crystallization sites, fillers, reinforcements and/or opacifiers, as described in U.S. Pat. No. 4,402,892 issued Sept. 6, 1983, to Helser, it is the solid foam itself, rather than the fibers, which produces the insulation effect. In order for such insulation to fill a void, it is first produced in a fluent form and then cured or dried to form the solid foam. Thus, the fluent foam must be capable of substantial solidification into a permanent body. Materials which are capable of this solidification such as a cementitious material, as described in the Helser patent, or resin materials as described in U.S. Pat. No. 4,103,876 issued Aug. 1, 1978, to Hasselman, Jr. et al. and U.S. Pat. No. 4,135,882 issued Jan. 23, 1979, to Harkness et al. are typically more expensive than fibrous insulation materials. Furthermore, many foamed insulation materials require relatively expensive and time-consuming additional steps to accomplish curing or drying, such as a heating step.

U.S. Pat. No. 4,447,560 issued May 8, 1984, to Piersol describes forming a fibrous sheet by agitating a mixture of a foamable solution and a slurry of binder-coated insulation fibers to homogeneously suspend the fibrous slurry. In contrast, the present invention does not utilize a slurry of fiber and binder materials but requires the use of pressurized air to provide spreading of insulation fibers to achieve a desired degree of fiber "fluffiness." Additionally, the foam material desired herein is already in its agitated state when it is mixed with the fibers. Furthermore, the insulation mixture of the present invention is directly blown into a formed cavity at a building construction site; there is no formation of a batt-type insulation or a standard sheet of fibrous material. There is also no step of heating for drying purposes after the insulation material is located in the cavity.

SUMMARY OF THE INVENTION

The present invention is useful in providing a blown-in fibrous insulation which has a substantially homogeneous density so as to provide for uniformity of insulation. A foaming agent is mixed with pressurized air to create a foam which is then introduced into a mixing chamber of a nozzle. Substantially dry fibrous particles are mixed with pressurized air to produce lofted fibers. The lofted fibers are also introduced into the mixing chamber of the nozzle. In the mixing chamber, the lofted fibers are mixed with the foamed material so that the foam maintains the loft or the desired spreading of the insulation fibers relative to each other. The mixture of fibers and foamed material is forced under pressure away from the nozzle and the foam material continues to maintain the desired loft or spreading of the fibers during the ejection of the mixture towards a desired space. The mixture is received in the desired space where the foam continues to maintain the desired loft or spreading of the insulation fibers to achieve uniformity of the insulation. Because of the presence of the foam, the lofted fibers in the desired space are able to withstand the impact from subsequent application of the mixture and are able to maintain the loft or separation of fibers in spite of the weight of insulation material above.

Preferably, the foamed material includes an amount of adhesive. After the mixture has been sprayed into the desired space, the adhesive material, after drying, acts to maintain the loft or separation of fibers even when the foam or liquid portion dries or dissipates. In this way, the dried blown-in insulation maintains its insulation capacity by virtue of the fibers present rather than depending on continued presence of a foam. The foam also acts to spread the adhesive for desired mixing with the fibers.

With regard to the nozzle itself, it includes a conduit that carries the foamed material and which tapers at the nozzle portion where the mixing of the fibers and foamed material occurs. This configuration is important in preventing back flow of material into the conduit, particularly when ever the flow of materials is discontinued for a time by shutting off the pressurized air.

DETAILED DESCRIPTION OF THE PREFERRED EMBODIMENT

Figure 1:
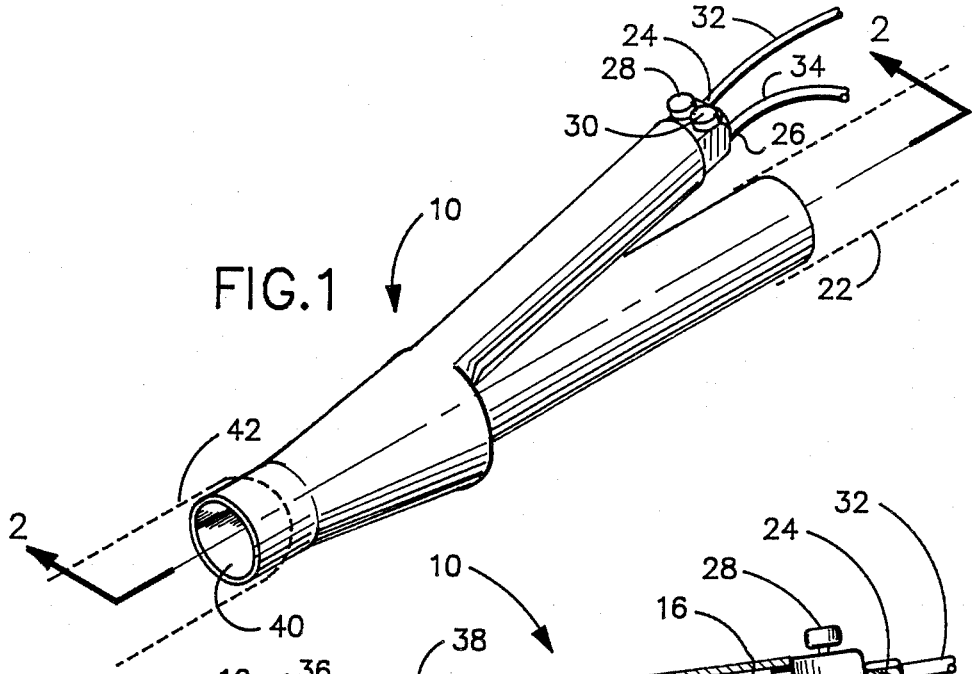
FIG. 1 is a schematic perspective view of a nozzle for mixing foamed material with lofted fibrous insulation.
Figure 2:
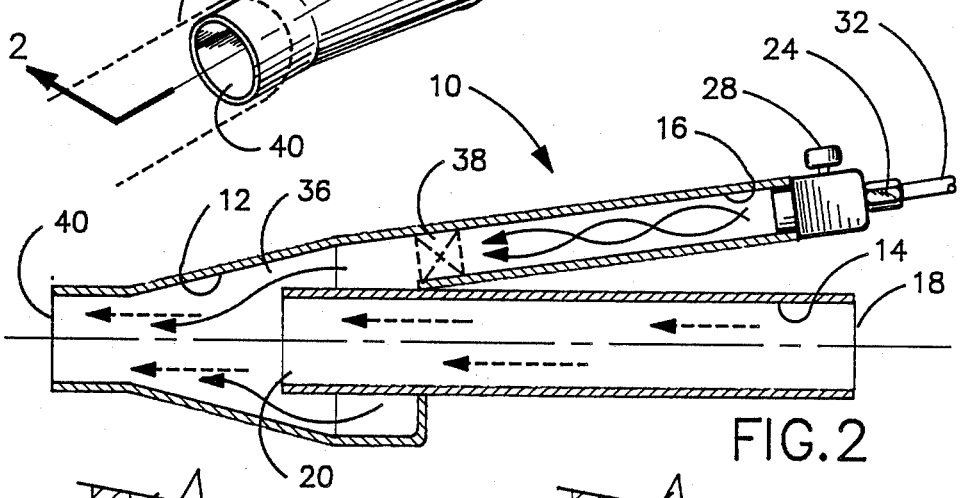
FIG. 2 is a cross-sectional view taken along line 2—2 of FIG. 1.

The present invention relates to mixing a foamed material with lofted fibrous insulation particles useful in providing fibrous blown-in insulation which has a substantially homogeneous density. Referring now to FIGS. 1 and 2, a nozzle 10 includes a mixing chamber 12, a first conduit 14, and a second conduit 16. The first conduit 14 has an entrance port 18 and an exit port 20. The exit port 20 communicates with the mixing chamber 12. The entrance port 18 of the first conduit 14 is preferably connected to a hose or pipe 22 for introduction through the entrance port 18 of fibrous particles as described below. The second conduit 16 has first and second entrance ports 24, 26 controllable by first and second valves 28, 30, respectively. Connected to the entrance ports 24, 26 are feed lines 32, 34 for introduction of foaming material and pressurized gas, respectively. The second conduit 16 has an exit port 36 communicating with the mixing chamber 12. In the region of the second conduit 16 near the exit port 36, the second conduit 16 is expanded to be located outwardly of the first conduit 14, preferably surrounding the first conduit 14 as a collar. The second conduit 16 tapers towards the first conduit 14 at the mixing chamber 12. The second conduit 16 preferably contains one or more baffles or obstacles 38 to assist in foam production. The mixing chamber 12 includes an exit port 40 which can be attached to a hose or pipe 42 for directing the insulation material.

The manner of using the nozzle 10 and of production and placement of insulating material will now be described. A foaming agent is introduced through the first line 32 and through the first entrance port 24 into the second conduit 16, with the rate of flow being controlled by the first valve 28. Any of a number of foaming materials well known in the art can be used. A pressurized gas, such as air, is introduced through the second line 34 and through the second entrance port 26 at a rate controlled by the second valve 30. Inside the second conduit 16, the pressurized air mixes with the foaming material for use in producing a foam which moves through the second conduit 16. The baffle or obstacle 38 can be used to assist in producing foam. The foamed material in its foamed state moves through the exit port 36 of the second conduit 16 and into the mixing chamber 12.

Substantially dry, lofted fibrous particles which have been lofted by mixing with pressurized air are introduced through entrance port 18 into the first conduit 14. The fibrous material can be any fiber well known in the art including mineral fibers, recycled paper and fiberglass. The lofted fibers and pressurized air move through the first conduit 14 and through the exit port 20 of the first conduit 14 into the mixing chamber 12.

In the mixing chamber 12, the foam material in its foamed state mixes with the lofted fibers and is forced by the pressurized air entering the nozzle 10 through the exit port 40 of the nozzle 10 and away from the nozzle 10. The tapered area of the second conduit 16 assists in preventing back flow of material into the conduits, particularly the second conduit 16. Such back flow can occur, for example, when flow of insulation material through the nozzle 10 is stopped. If flow of the mixed fibers and foamed material were permitted back into the second conduit 16, it would be necessary for the operator to frequently clean out or unplug the conduit 16 whenever flow of the materials is stopped by the operator for some reason, such as moving the apparatus to a new cavity for filling with the insulation.

The proportion in which the components are mixed, and particularly the proportion of liquid foaming material to pressurized gas and other material, is preferably adjusted so that the resulting mixture which is ejected from the nozzle 10 has a low moisture content per volume. In that regard, in practicing the method of the present invention, an external heat source is not required. In one embodiment, a foam which contains one volume of liquid in 30 volumes of final insulation product as delivered will be operable, although other proportions are operable as well.

An amount of adhesive material can be included in the foam material, for example, by introduction through the first line 32, mixed with the foaming material. Any adhesive material capable of adhesion to the fibrous particles can be used provided it does not interfere with the foaming process. For example, foamable adhesives such as polyvinyl acetate, ethylvinyl acetate, animal glues and the like can be used. The adhesive material is preferably provided in sufficient quantity that it is capable of maintaining the loft of the fibrous particles after it has cured or set. The adhesive material preferably has a curing or setting time sufficiently short that it cures or sets before substantial drying or dissipation of the foam.

Figure 3:
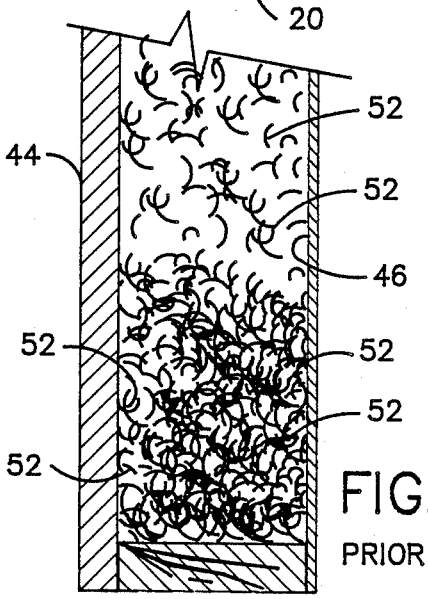
FIG.3 PRIOR ART
FIG. 3 is a schematic cross-sectional view of insulation in a typical stud-construction wall cavity showing compaction of fibers in the lower portion thereof in accordance with the prior art.
Figure 4:
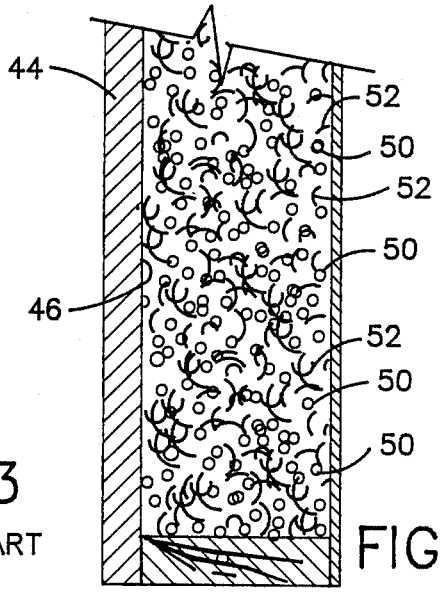
FIG. 4 is a schematic cross-sectional view of the lofted fibers-foam mixture in a typical stud-construction wall cavity.

The mixture of fibers and foam material which is forced away from the nozzle 10 is directed to and received in a space where insulation is desired. In a typical application, the mixture is directed into the cavity of a typical stud-construction wall 44 whereby the foamed insulation can be made and installed at the construction site. As depicted in FIG. 4, the foam material 50 is used to maintain loft or spreading of the insulation fibers 52 relative to each other. The foam 50 maintains such loft or spreading of fibers even when it is impacted by subsequent applications of the mixture ejected from the nozzle 10 and maintains loft or separation of fibers in spite of the weight of insulation material above. In contrast, FIG. 3 schematically depicts the compaction of fibrous insulation that occurs in portions of a wall cavity 46 when the product and process of the present invention are not utilized, but only pressurized air that is used to blow the fibers into the wall cavity.

After the mixture has been placed in the cavity 46 as depicted in FIG. 4, the moisture in the mixture dries in the ambient atmosphere, without the necessity for application of heat or other drying procedures. With the drying of the moisture, the foam 50 dissipates leaving only the fibrous particles 52 which are, preferably, maintained in a desired, spread state using the adhesive material.

In light of the above discussion of the preferred embodiment, a number of advantages of the present invention are apparent. A blown-in fibrous insulation is provided which results in substantial uniformity of insulation, i.e., substantially homogeneous density. The foamed insulation of the present invention can be made and installed on the job or construction site. Although a foam is used, it does not have to be used to create loft or to create air pockets, but rather is used to maintain a previously-established loft between fibrous particles. Indeed, the foam itself eventually dissipates leaving lofted fibrous particle insulation. Because the insulation is blown-in rather than being a batt-type insulation, the insulation does not need to be extensively handled and thus does not have to have a high degree of adhesion, but rather only that amount of adhesion necessary to maintain loft. Therefore, very little adhesive need be added and the resulting mixture can dry quickly and without application of heat. Because the foam is used only to maintain an already-created loft and is not a structural component of the insulation, at least in the long-term, the foam can be relatively dry, also contributing to rapid drying of the insulation in the desired space without the requirement for application of heat. As opposed to a permanent foam insulation, the blown-in fibrous insulation uses relatively inexpensive materials such as recycled paper, mineral fibers or fiberglass and is easy to apply, conforming naturally to obstacles such as wiring, pipes and the like. Additionally, a tapered nozzle portion of the present invention reduces or prevents the flow of foamed insulating material back into the conduit that carries the mixture of foaming material and adhesive. As a consequence, this conduit does not become plugged with fiber material.

Although the present invention has been described with reference to certain embodiments, it should be appreciated that further modifications can be effected within the spirit and scope of the invention.

What is claimed is:

1. An apparatus for ejecting fibrous insulation into a desired space comprising:
- a nozzle defining a mixing chamber and having an ejection port;
- a first conduit having an exit port, said exit port communicating with said mixing chamber;
- first means for introducing substantially dry fibrous particles lofted by pressurized air into said first conduit and for carrying said substantially dry lofted fibrous particles through said first conduit into said mixing chamber using pressurized air and wherein said fibrous particles are in a substantially dry lofted state when said fibrous particles enter said mixing chamber;
- a second conduit having first and second entrance ports and an exit port, said exit port communicating with said mixing chamber;
- second means for introducing a liquid comprising a foaming agent into said second conduit through said first entrance port; and
- third means for introducing pressurized air into said second conduit through said second entrance port, wherein a foam material in its foamed state moves through said second conduit into said mixing chamber to form a mixture with said substantially dry lofted fibrous particles, wherein said mixture is ejected through said ejection port into the desired space and wherein at least a substantial majority of said foam material in its foamed state is dissipated following said ejection.

2. An apparatus, as claimed in claim 1, wherein:
- said second conduit is located outwardly of said first conduit and said second conduit tapers towards said first conduit at said mixing chamber.

3. A method for filling a space with fibrous insulation comprising:
- providing pressurized air;
- providing substantially dry fibrous particles;
- lofting said substantially dry fibrous particles using pressurized air;
- carrying said substantially dry lofted fibrous particles using pressurized air;
- supplying separately a foam material in its foamed state using pressurized air;
- mixing said foam material in its foamed state with said substantially dry lofted fibers to produce foamed fiber insulation;
- outputting said foamed fiber insulation to a space; and
- dissipating at least a substantial majority of said foam material in its foamed state wherein said space is substantially filled with said fibrous particles.

4. A method, as claimed in claim 3, wherein:
- said step of mixing said foam and said fibers includes mixing them in nozzle means.

5. A method, as claimed in claim 3, wherein:
- said step of supplying a foam material comprises supplying a foam material including an adhesive.

6. Fibrous insulation having substantially homogeneous density produced by a process comprising the steps of:
- providing pressurized air;
- providing substantially dry fibrous particles;
- lofting said substantially dry fibrous particles using pressurized air;
- carrying said substantially dry lofted fibrous particles using pressurized air;
- supplying separately a foam in its foamed state using pressurized air;
- mixing said foam in its foamed state with said substantially dry lofted fibers to produce foamed fiber insulation;
- outputting said foamed fiber insulation to a space; and
- dissipating at least a substantial majority of said foam material in its foamed state wherein said space is substantially filled with said fibrous particles.

7. A method for filling a space with insulating material, comprising:
- providing nozzle means;
- providing pressurized air;
- providing substantially dry fibrous particles;
- lofting said substantially dry fibrous particles using pressurized air;
- feeding said substantially dry fibrous particles towards said nozzle means using pressurized air;
- providing a foam material in its foamed state;
- mixing in said nozzle means said substantially dry fibrous particles in a lofted state and said foam material in its foamed state;
- forcing said mixture of fibers and foam material under pressure away from said nozzle means;
- using said foam material to maintain a desired spreading of said insulation fibers relative to each other during the ejection of said mixture towards the space;
- receiving said mixture at the space for insulation purposes;

using said foam of said mixture during continuous receiving of the mixture at the space to maintain the desired spreading of said insulation fibers in order to achieve uniformity of insulation; and dissipating at least a substantial majority of said foam material in its foamed state wherein said space is substantially filled with said fibrous particles.

8. A method, as claimed in claim 7, wherein:

said mixing step includes using pressurized air to maintain a desired spreading of said insulation fibers when said fibers contact said foam material.

9. A method, as claimed in claim 7, wherein:

said step of providing a plurality of insulation fibers includes providing said insulation fibers in a substantially dry state and said step of mixing in said nozzle means includes mixing said substantially dry insulation fibers with said foam material in its foamed state.

10. A method, as claimed in claim 7, wherein:

said step of providing a foam material comprises supplying a foam material including an adhesive.

* * * * *